US008221201B2

(12) United States Patent
Christensen et al.

(10) Patent No.: US 8,221,201 B2
(45) Date of Patent: Jul. 17, 2012

(54) WINDOW WITH A VENTILATION DEVICE

(75) Inventors: Poul Christensen, Lunderskov (DK); Jens Arboe Harild, København K (DK); Soren Møller Madsen, Espergaerde (DK); Niels Herskind, København K (DK)

(73) Assignee: Poul Christensen, Lunderskov (DK)

( * ) Notice: Subject to any disclaimer, the term of this patent is extended or adjusted under 35 U.S.C. 154(b) by 684 days.

(21) Appl. No.: 11/665,930

(22) PCT Filed: Oct. 19, 2005

(86) PCT No.: PCT/DK2005/000676

§ 371 (c)(1),
(2), (4) Date: Feb. 29, 2008

(87) PCT Pub. No.: WO2006/042550

PCT Pub. Date: Apr. 27, 2006

(65) Prior Publication Data

US 2010/0009619 A1 Jan. 14, 2010

(30) Foreign Application Priority Data

Oct. 21, 2004 (DK) ..... 2004 01617

(51) Int. Cl.
*F24F 7/00* (2006.01)
*E06B 7/02* (2006.01)
*E06B 7/10* (2006.01)

(52) U.S. Cl. ..... 454/196; 454/211

(58) Field of Classification Search ..... 454/196, 454/211, 28, 200, 222; 98/88; 49/2
See application file for complete search history.

(56) References Cited

U.S. PATENT DOCUMENTS

| | | | | | |
|---|---|---|---|---|---|
| RE14,141 | E | * | 5/1916 | Fair | 454/211 |
| 1,409,050 | A | * | 3/1922 | Jurisch | 160/104 |
| 1,499,278 | A | * | 6/1924 | Wingfield | 236/46 R |
| 1,588,855 | A | * | 6/1926 | Sachse | 49/171 |
| 1,798,192 | A | * | 3/1931 | Clifford | 60/530 |
| 1,976,032 | A | * | 10/1934 | Morton | 454/196 |
| 2,039,826 | A | * | 5/1936 | Morton | 454/200 |
| 2,310,127 | A | * | 2/1943 | Smith | 160/19 |
| 2,368,182 | A | * | 1/1945 | Vernet | 60/527 |
| 2,552,735 | A | * | 5/1951 | Rawson | 236/49.5 |
| 3,094,058 | A | * | 6/1963 | O'Brien, Jr. et al. | 454/195 |
| 3,103,158 | A | * | 9/1963 | Noll | 49/2 |
| 3,115,223 | A | * | 12/1963 | Shustrom | 49/2 |

(Continued)

FOREIGN PATENT DOCUMENTS

DE 30 43 783 A1 6/1982

(Continued)

*Primary Examiner* — Steven B McAllister
*Assistant Examiner* — Phillip E Decker
(74) *Attorney, Agent, or Firm* — Miles & Stockbridge P.C.; David R. Schaffer, Esq.

(57) ABSTRACT

A ventilation device for ventilation of a building having a double-window construction with an air space. The device communicates with the open air space and has four throttles. The first and the second throttles can selectively cut off the passage of air from the air space into a first and a second chamber, respectively, of the device. The third throttle can selectively cut off the passage of air from the first chamber and into the building. The fourth throttle can selectively cut off the passage of air between the open air space and the first and the second chamber. Temperature-sensitive actuators can activate the throttles, selectively adjusting air flow.

8 Claims, 15 Drawing Sheets

U.S. PATENT DOCUMENTS

| | | | | | |
|---|---|---|---|---|---|
| 3,210,003 | A | * | 10/1965 | Quinton | 236/35.2 |
| 3,259,053 | A | * | 7/1966 | Steel | 454/200 |
| 3,343,475 | A | * | 9/1967 | Costley | 454/275 |
| 3,523,501 | A | * | 8/1970 | Willert | 454/222 |
| 4,155,504 | A | * | 5/1979 | Caldwell | 236/49.5 |
| 4,255,899 | A | * | 3/1981 | Braithwaite | 49/2 |
| 4,295,417 | A | | 10/1981 | Isley et al. | |
| 4,369,766 | A | * | 1/1983 | Coley | 126/572 |
| 4,450,687 | A | * | 5/1984 | Cole | 60/530 |
| 4,641,466 | A | * | 2/1987 | Raninen et al. | 52/171.3 |
| 4,643,246 | A | * | 2/1987 | Ikemura et al. | 165/54 |
| 4,832,260 | A | * | 5/1989 | Spilde | 236/49.4 |
| 5,816,306 | A | * | 10/1998 | Giacomel | 160/6 |
| 6,240,728 | B1 | * | 6/2001 | Gadini | 60/529 |
| 6,878,055 | B2 | * | 4/2005 | Lafleur | 454/196 |
| 7,238,105 | B2 | * | 7/2007 | Reinders | 454/223 |
| 7,270,600 | B2 | * | 9/2007 | Kim et al. | 454/198 |
| 2004/0253917 | A1 | * | 12/2004 | Kim et al. | 454/200 |
| 2006/0270334 | A1 | * | 11/2006 | Kim et al. | 454/200 |
| 2008/0104900 | A1 | * | 5/2008 | Joasil | 52/171.3 |

FOREIGN PATENT DOCUMENTS

| | | | | |
|---|---|---|---|---|
| DE | 3732545 | A1 | * | 4/1989 |
| DE | 40 26 057 | | | 12/1991 |
| EP | 164111 | A2 | * | 12/1985 |
| EP | 1 486 637 | A | | 12/2004 |
| SU | 1000553 | A | * | 3/1983 |

* cited by examiner

WINDOW WITH A VENTILATION DEVICE

The present invention relates to a ventilation device. The invention moreover relates to a method of ventilating a room in a building by use of a ventilation device.

From Swedish patent publication No. 429 251 a window construction is known, where air from the outside is conveyed inside at the bottom of the window construction and in between the glass panes of the window construction to be conveyed into the building at the top of the window construction.

However, the above construction does not allow controlling of the amount of air and the temperature in the building simultaneously with a certain supply of fresh air to the building being accomplished.

It is thus an object of the invention to provide a system, by which the problems associated with the prior art are obviated.

According to the invention, this is accomplished by the ventilation device and by the method described herein.

Advantageous embodiments of the invention will appear from the subclaims.

Hereby a ventilation device is accomplished by which, in particular situations, it is possible to regulate the amount of air and the temperature in the air space of the window and hence in the room of the building, while simultaneously ensuring that a certain amount of air is supplied to the room of the building.

In the following the invention will be explained in further detail with reference to the preferred embodiment shown in the drawing, wherein:

FIGS. 1*a-c* show a sketch of a window with a ventilation device in different working positions; and FIG. 2 is a sectional view of a window frame with a ventilation device; and FIGS. 3*a-d* show the ventilation device seen in four positions; and FIG. 4 depicts air flow when temperature between glass panes is 14° C.

Figure 1A:
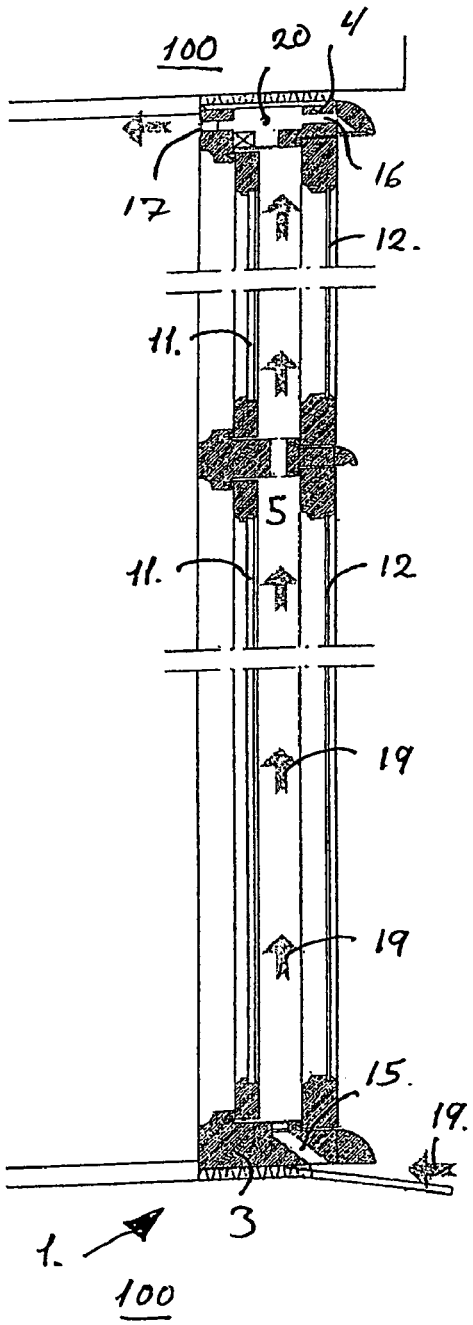
Figure 1B:
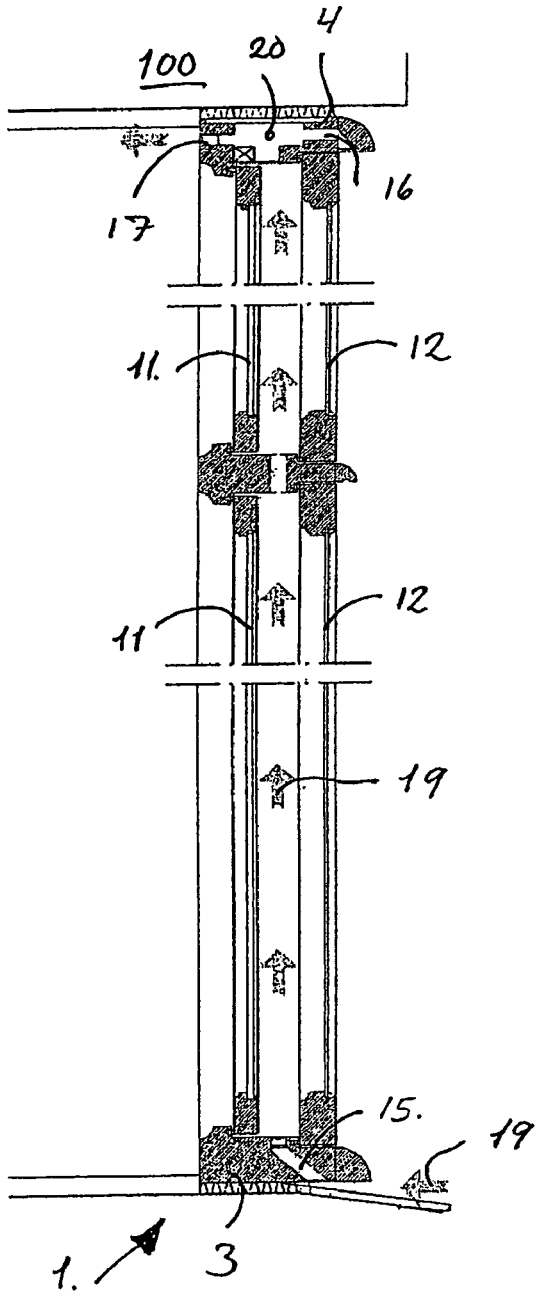
Figure 1C:
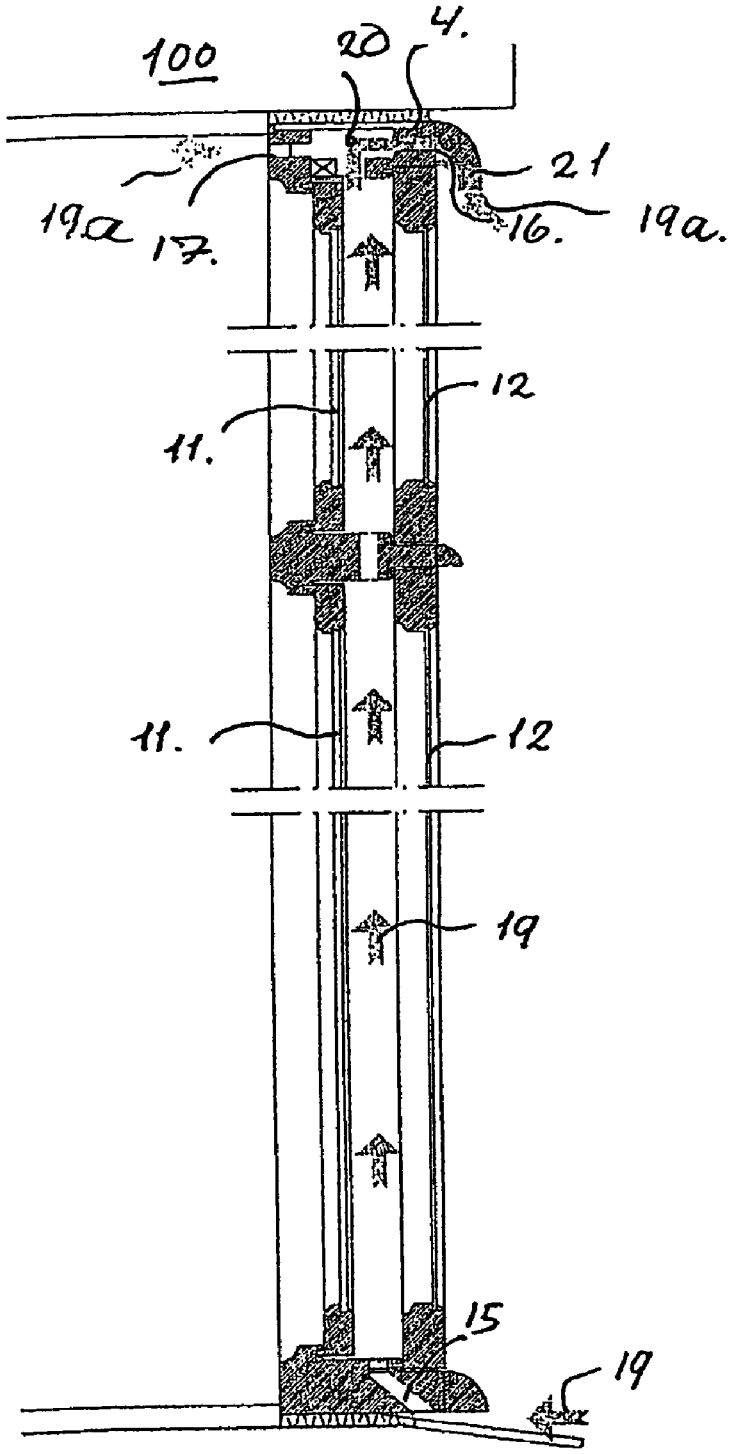

FIGS. 1*a-c* show a vertical sectional view through a window comprising a frame with an upper frame element 4 and a bottom frame element 3, between which two glass panes 11, 12 (first glass pane and second glass pane respectively) are configured in parallel and at a distance from each other. In the drawing, these glass panes are shown as single glass panes, but it will be understood that in accordance with the invention they may also be constituted of double glazing or double glass panes. In the upper frame element 4 a ventilation device 20 according to the invention is incorporated.

Between first glass pane and second glass pane 11, 12 shown in FIGS. 1*a-c*, an air space 5 is provided that communicates with the open air by means of a first flow passage 15 in the bottom frame element 3 and a third flow passage 16 in the upper frame element, respectively. The air space 5 also communicates with the interior of the building (a room in the building) by means of a second flow passage 17 which is also configured in the upper frame element 4. These flow passages 15, 16, 17 thus allow a flow of air into and out of the room of the building.

In the air space 5 there will, due to heat transmission from the glass panes and incident radiation from the sun, be provided an ascending heated flow of air. Depending on the actual conditions, including eg the season and the current outdoor temperature, the heated flow of air can be conveyed via the third flow passage and second flow passage 16, 17 in the upper frame element either into the room of the building or out into the open. Simultaneously herewith a corresponding amount of fresh air will be drawn inwards through the first flow passage (air intake) 15 in the bottom frame element 3 and into the air space 5, where it is heated and maintains the ascending heated flow of air.

FIG. 1*a* shows a double window 1 with a ventilation device 20 according to the invention in usual operating conditions that will often occur during the firing/heating season. In such operating conditions, the outdoor temperature is below the desired room temperature of eg 21.degrees C. in the room of the building, and it is also possible to provide a temperature of the ascending heated flow of air in the air space 5 of eg above 12.degrees C. As is indicated by arrows 19, fresh air is drawn inwards through the first flow passage 15 and inwards at the bottom of the air space 5, where an ascending movement is imparted to the air flow through the air space 5 due to the heating of the flow of air. During its ascending passage through the air space 5, the heated flow of air has achieved a temperature that does not exceed 12 degrees C. and it is subsequently conveyed into the room of the building through the second flow passage 17.

FIG. 1*b* shows a minimal operating scenario that will typically occur in case of cold weather in eg wintry conditions, where the incident radiation from the sun will usually provide a minimal heat contribution. In that situation it will typically be difficult to cause the air in the air space to be elevated above 12 degrees C., and thus only minimal ventilation through the air space 5 is maintained. Compared to the normal operating scenario, in which the first throttle 33 and the second throttle 34 (the bottom throttles) at the bottom of the ventilation device 20 are open, the first throttle 33 and the second throttle 34 will change position in the minimal operating scenario. Thus, the throttle that extends throughout the entire length of the device will essentially be closed down to between 5-50% and preferably about 25% of the throttle opening degree compared to the normal operating conditions.

Figures 3A, 3B, 3C, 3D:
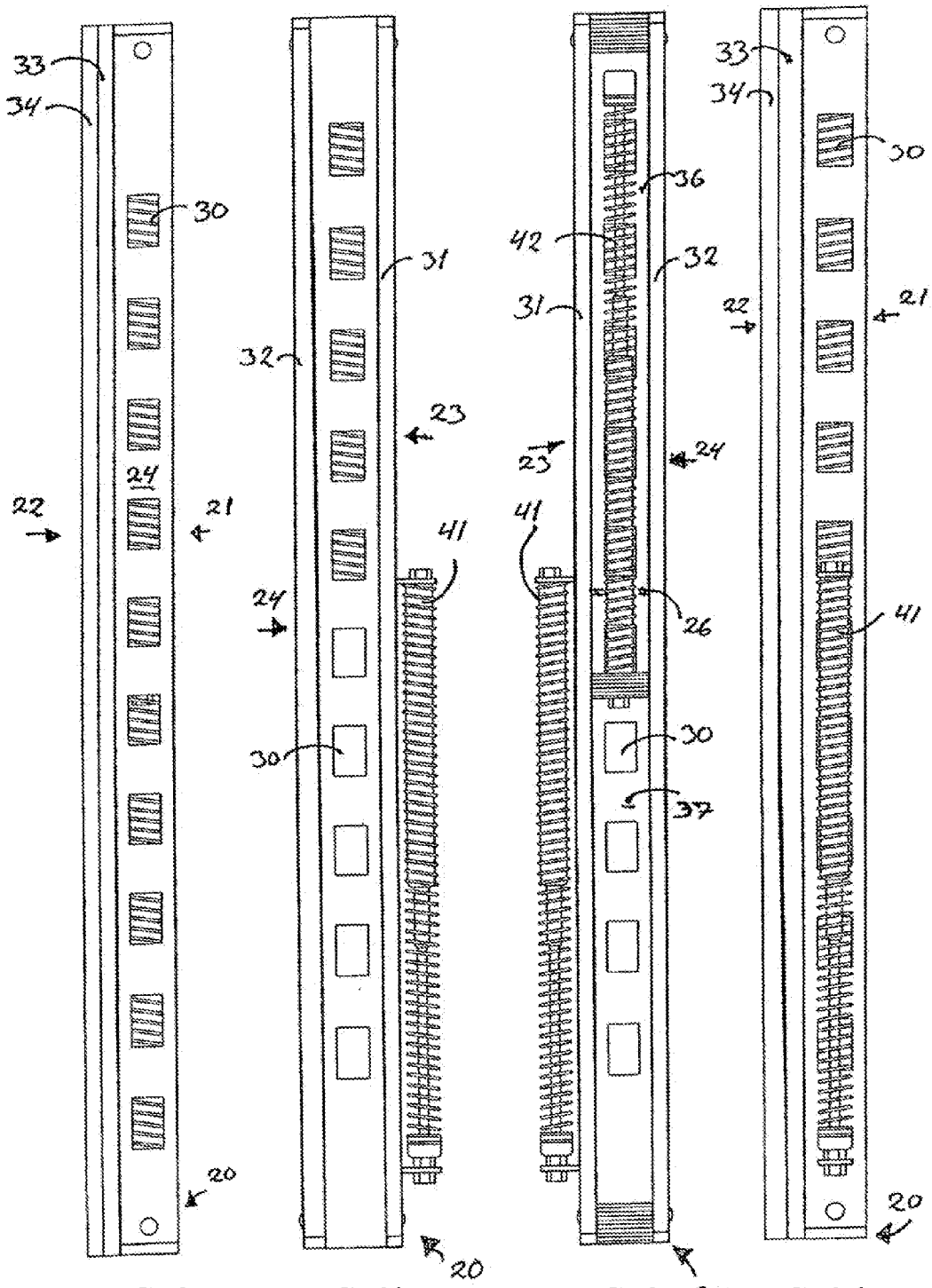
Figure 4:
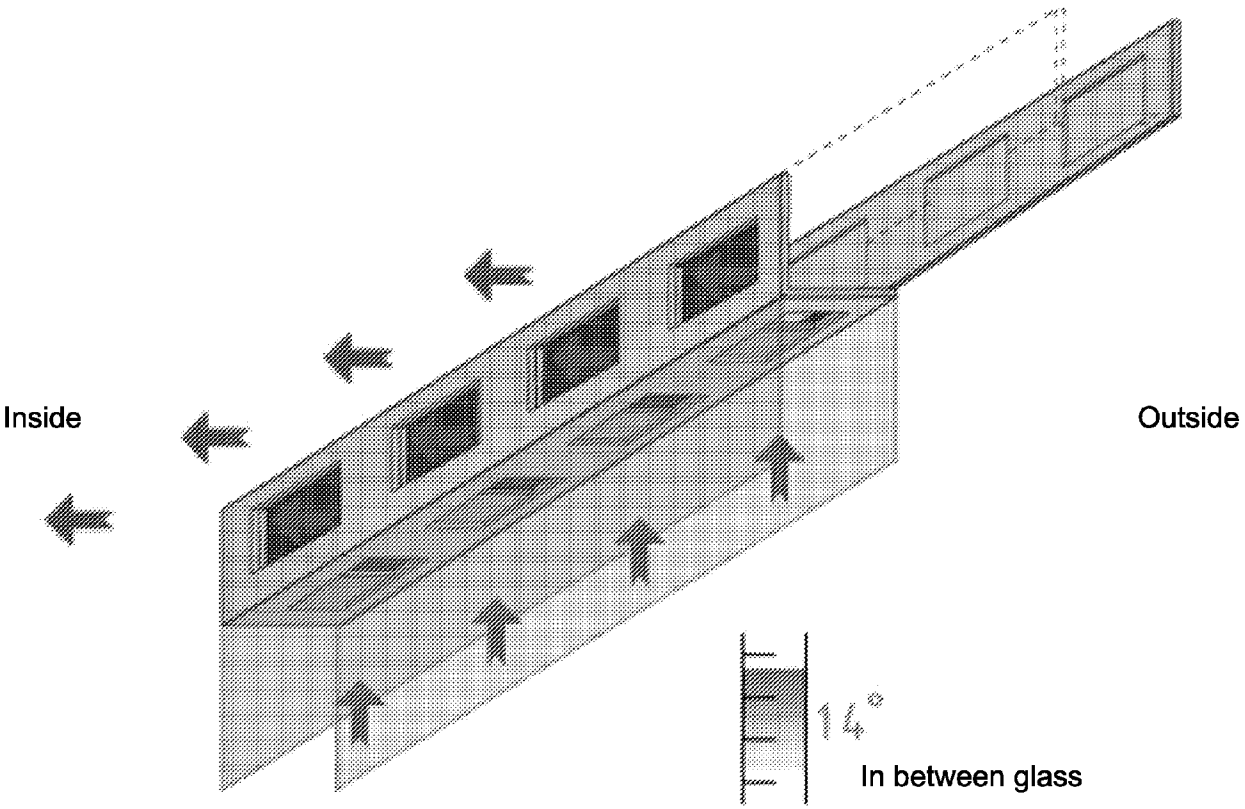
Figure 5:
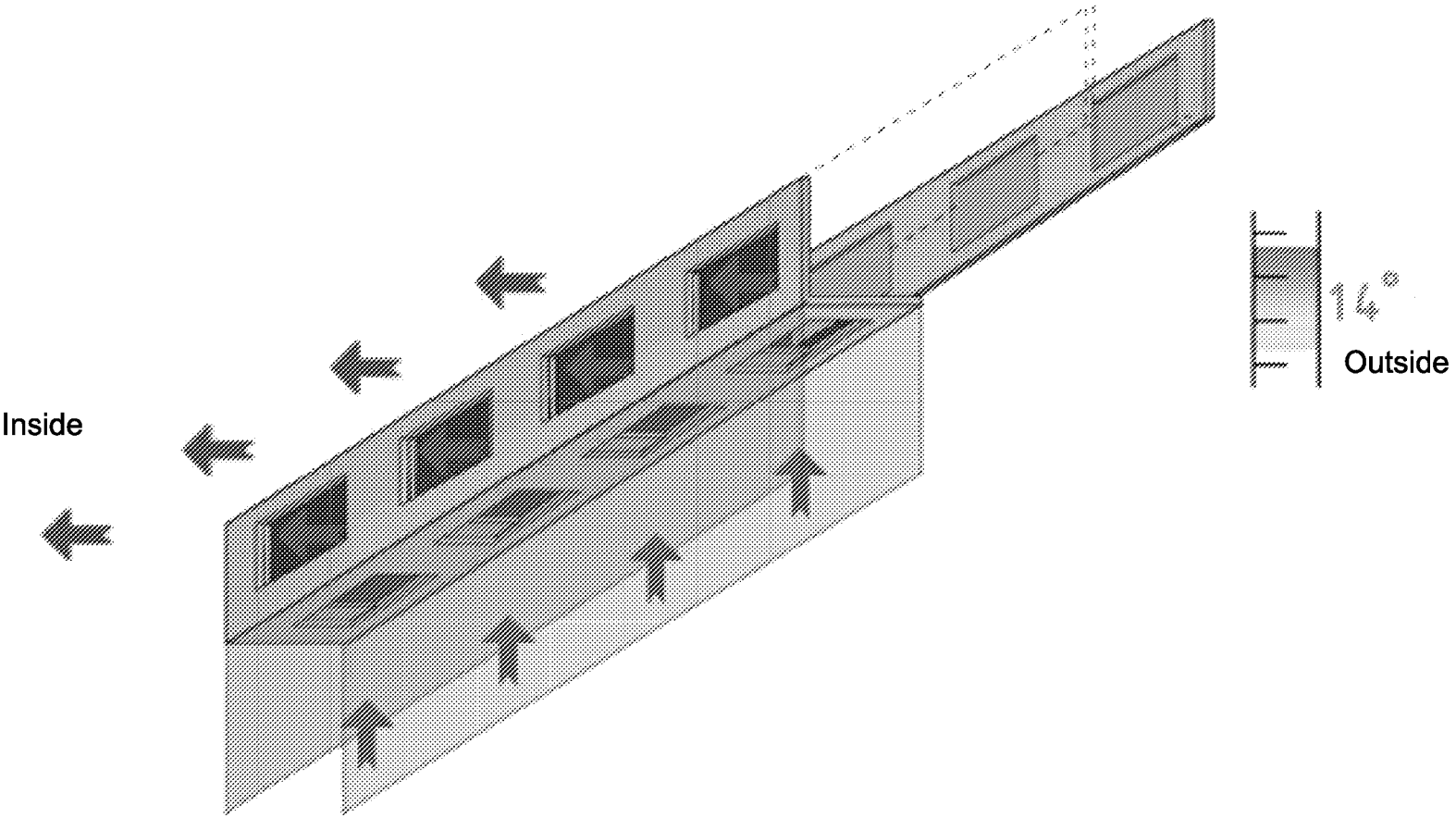
FIG. 5 depicts air flow when temperature between glass panes is 14° C.
Figure 6:
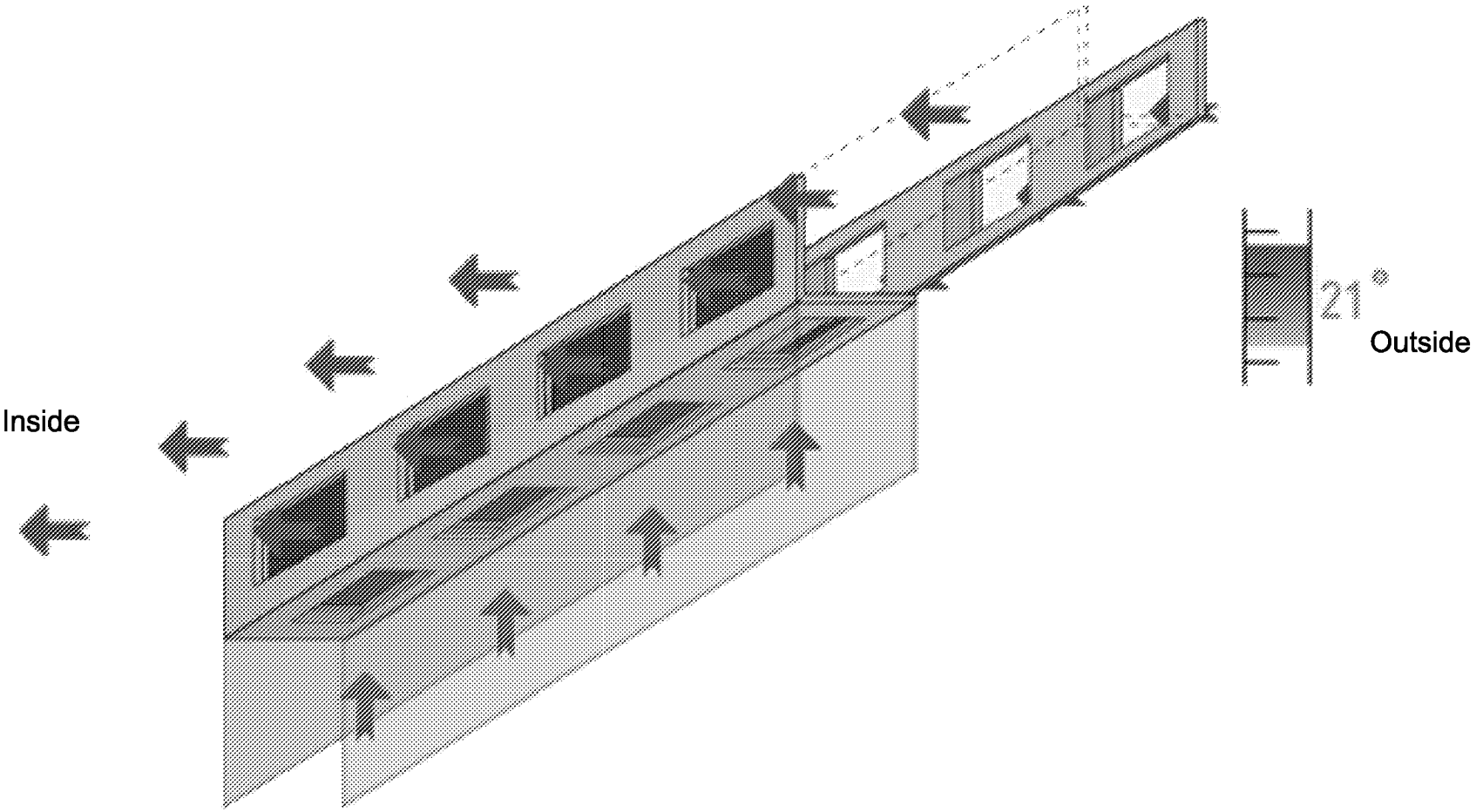
FIG. 6 depicts air flow when temperature between glass panes is 21° C.
Figure 7:
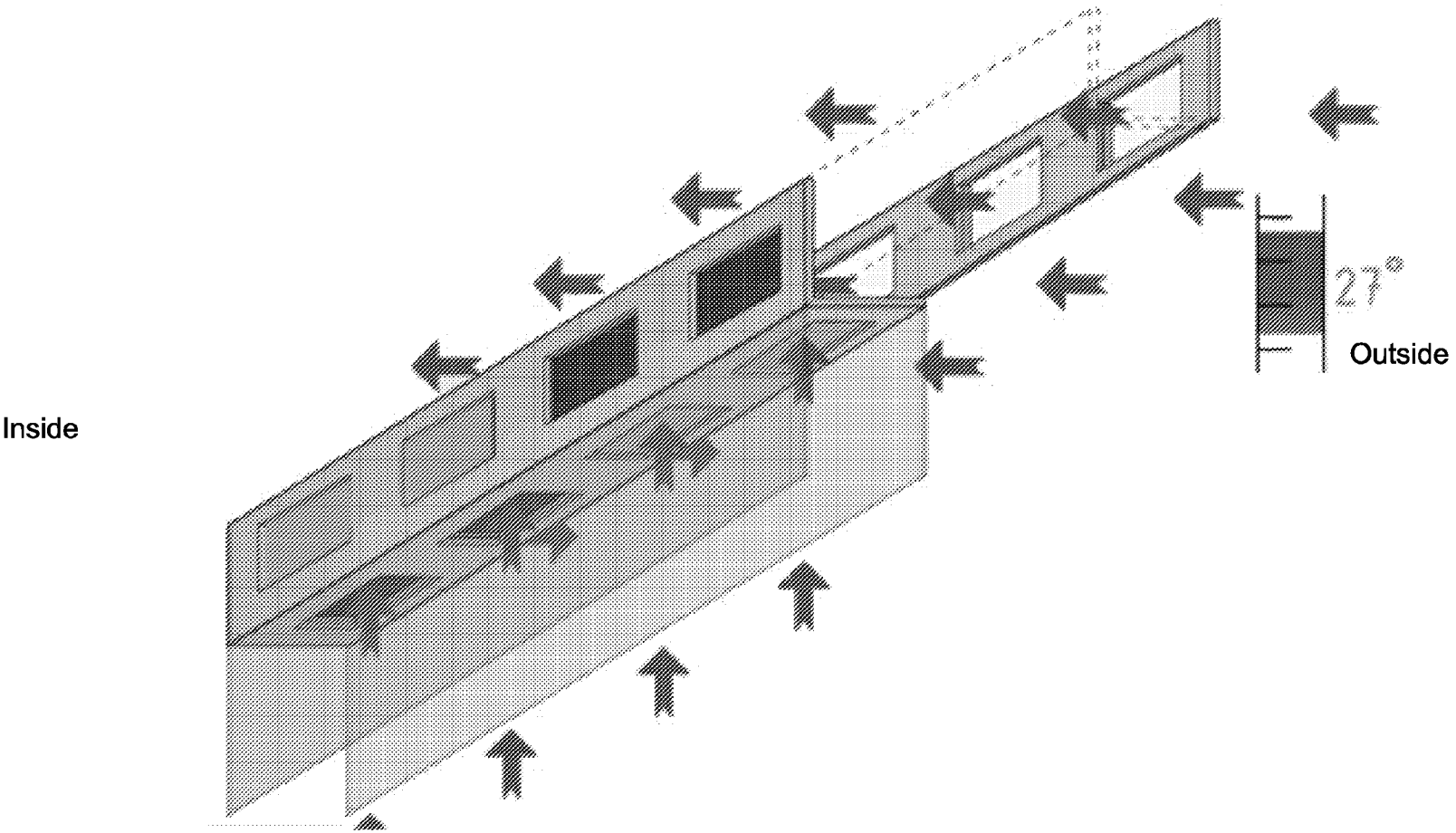
FIG. 7 depicts air flow when temperature between glass panes is 27° C.
Figure 8:
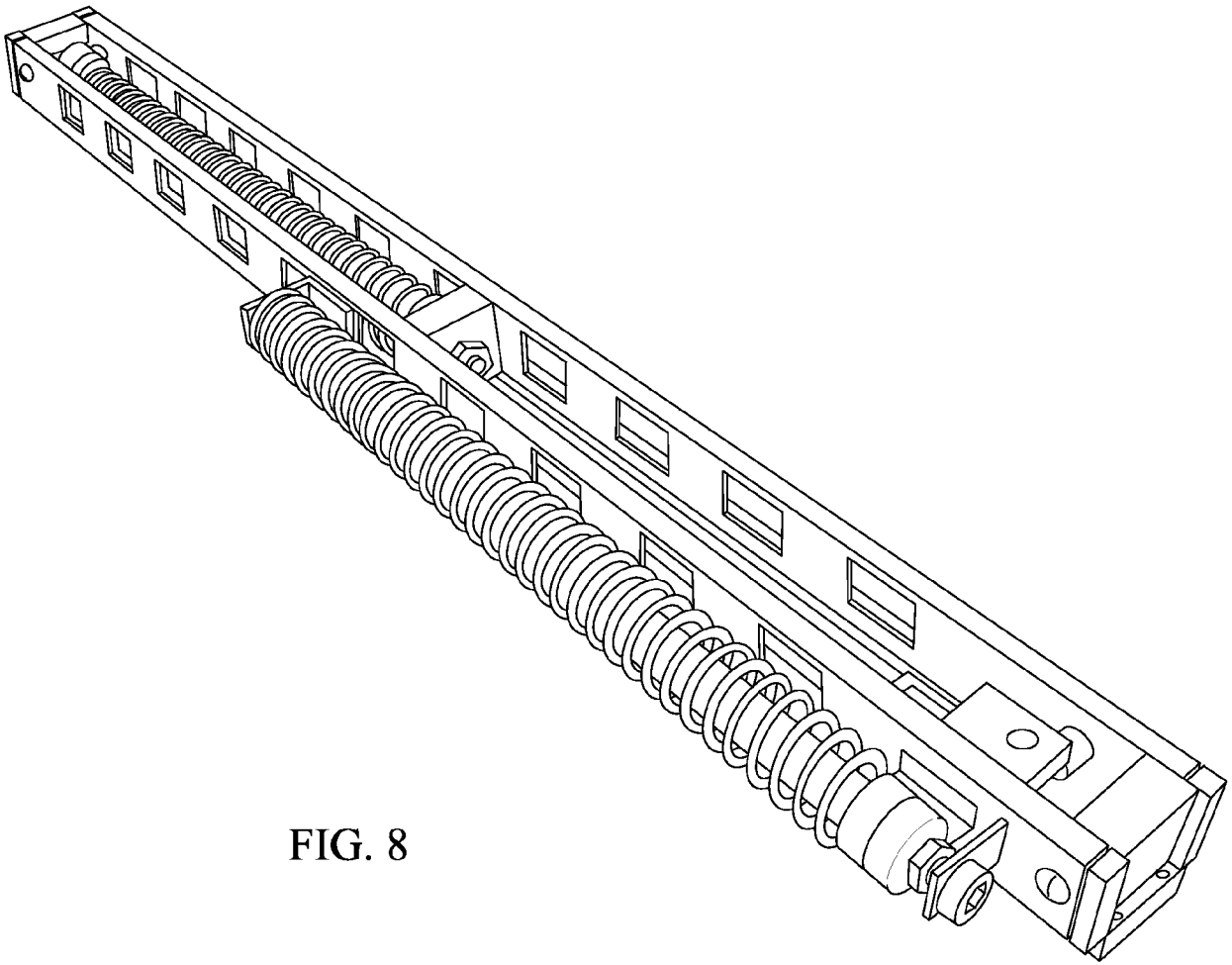
FIG. 8 illustrates a ventilation device for a double window as viewed from outside building.
Figure 9:
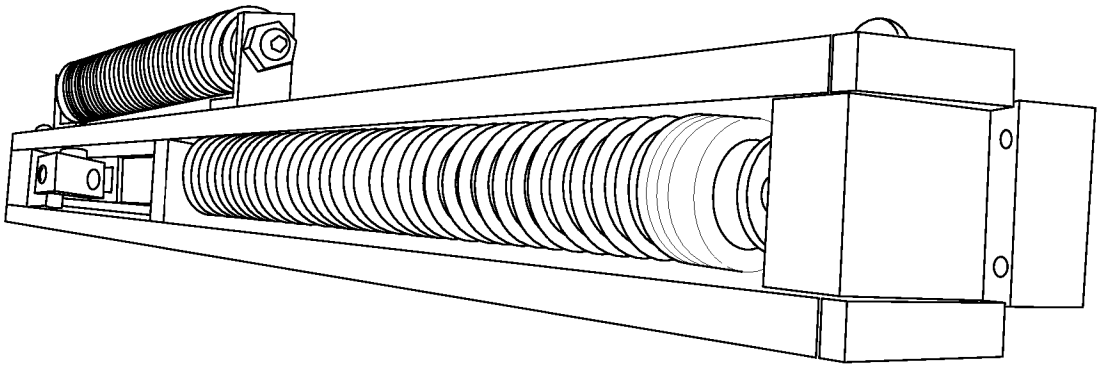
FIG. 9 illustrates a top view of a ventilation device for a double window.
Figure 10:
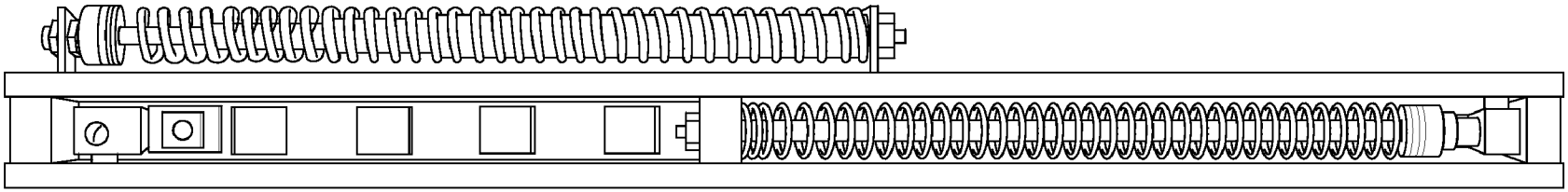
FIG. 10 illustrates a ventilation device for a double window.
Figure 11:
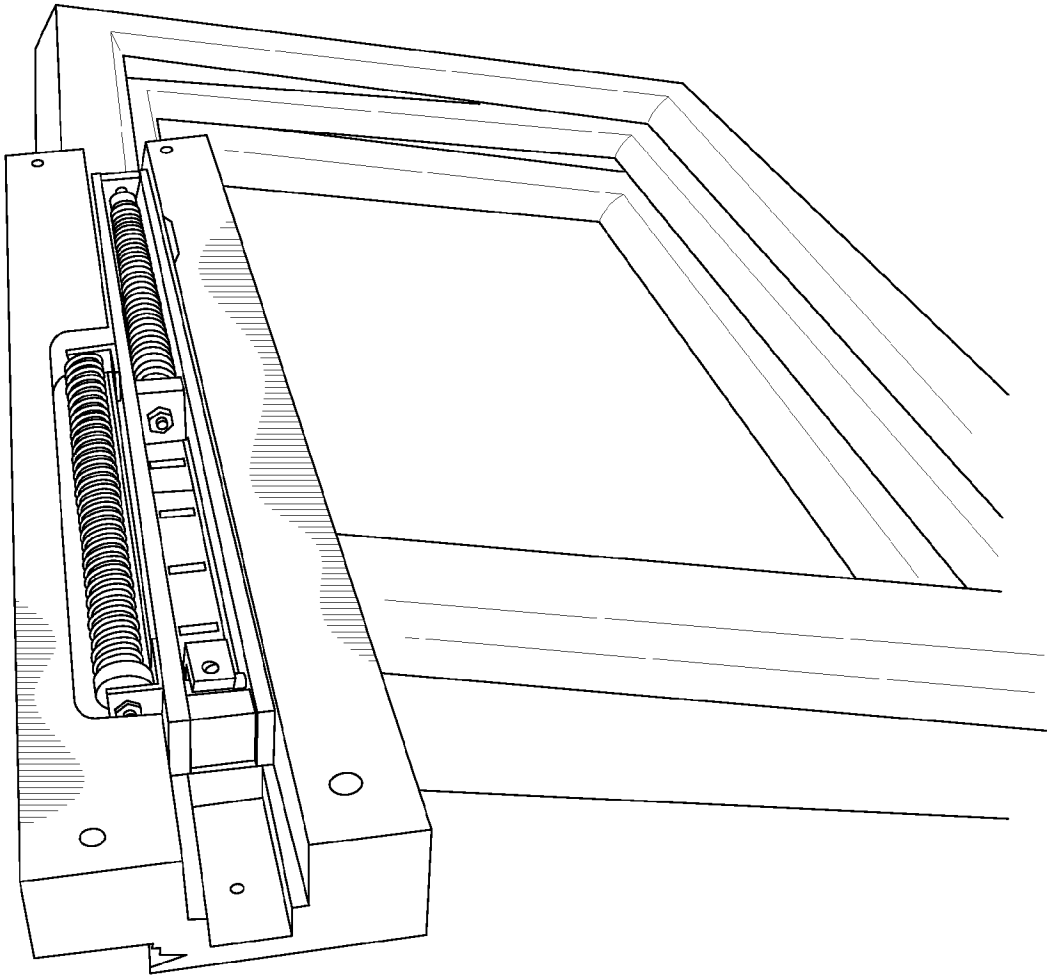
FIG. 11 illustrates a ventilation device for a double window.
Figure 12:
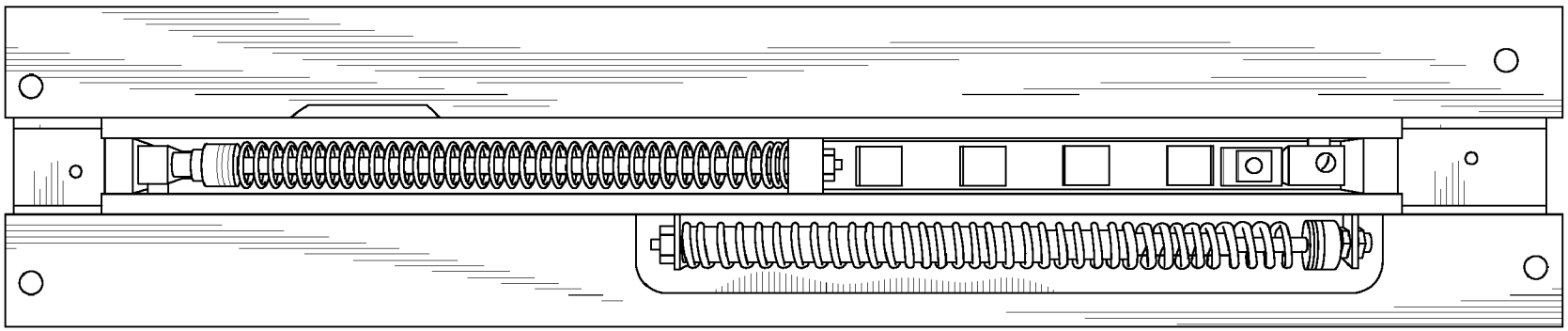
FIG. 12 illustrates a ventilation device for a double window.
Figure 13:
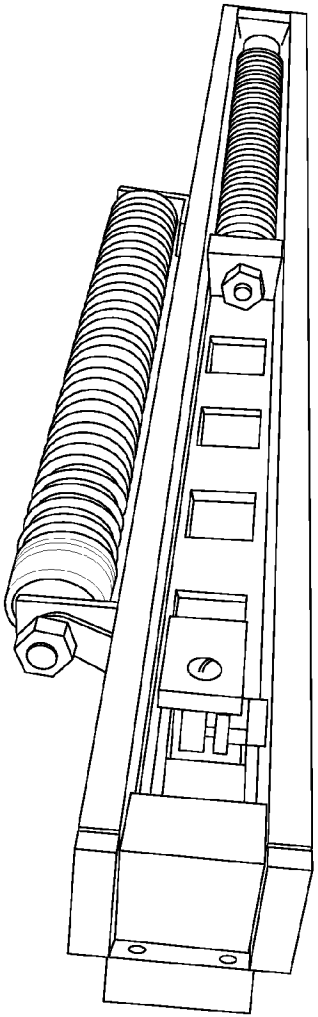
FIG. 13 illustrates a ventilation device for a double window.
Figure 14:
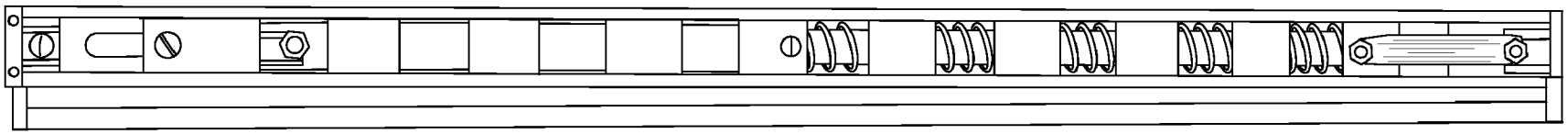
FIG. 14 illustrates a ventilation device for a double window as viewed from inside building.

Like the scenario explained in the context of FIG. 3*a*, an amount of fresh air is drawn inwards through the first flow passage 15 and inwards at the bottom of the air space 5, where an ascending movement is imparted to the air flow, upwards in the air space 5 due to heating of the air flow. By its passage upwards through the air space 5, the heated flow of air has accomplished a temperature that does not exceed 12 degrees C. and it is then conveyed into the room of the building through the second flow passage 17. In this context it will be understood that, in the minimum operating conditions, said flow of air is considerably smaller than the flow of air supplied to the room of the building in the usual operating conditions.

It will also be understood that the temperature set point of 12 degrees C. which was indicated to be advantageous in the context of normal and minimum operating conditions in accordance with the invention could assume any other value that would be more advantageous for the functioning in the particular situation.

FIG. 1*c* shows a cooling situation which will typically occur when the outdoor temperature is slightly above the desired room temperature, eg 21-23.degree. C. In this particular situation the fourth throttle 31 (the throttle towards the open air) will start to open at about 21 degrees C., whereby a direct flow of air is established between the open and the room of the building and preferably in a direction from the open through the ventilation device 20. In case of increasing outdoor temperature, the opening of the fourth throttle 31 will be increased until the outdoor temperature reaches about 23.degree. C., where the fourth throttle 31 will be fully open.

In particular situations when the outdoor temperature has increased to about 23.degrees C. or even more, the further traveling of the second actuator will involve a movement of the second throttle 34 (bottom throttle) in the second chamber 37, whereby a blocking of passages 30 towards the air space 5 is initiated. In the first chamber the third throttle 32 is also displaced, whereby closing of passages 30 towards the room in the building is initiated, and the flow of air in the passages 30 decreases.

In case of increasing outdoor temperatures (above 23.degrees C.) further traveling of the second self-operating thermohydraulic actuator 42 will mean that the second throttle 34 will block a larger portion of the passages 30 in the first chamber 36; and that the fourth throttle 31 will block a larger part of the passages 30 in the second chamber 37, until a temperature of about 27.degree. C. is reached, and passages 30 will become completely closed by second throttle 34 and fourth throttle 31 and second throttle 34 will be fully open.

In this particular situation free passage of air between the open and the room in the building will prevail in the second chamber 37, whereby a certain ventilation of the room in the building will be provided. The amount of air supplied into the air space 5 through the first flow passage 15 is, following heating in the air space 5, again conveyed via the first chamber 36 out at the top by air passing through second flow passage 17, whereby a cooling is accomplished by the air space 5. The inwards flow of air through the third flow passage 16 and on into the room of the building is indicated by arrows with reference number 19*a*.

Third throttle 32 and fourth throttles 31 configured at the bottom of the ventilation device 20 will advantageously be configured as separate displaceable throttles that are arranged in close connection with each other. The third throttle 32 will advantageously extend throughout the entire length of the ventilation device 20, and the fourth throttle 31 will have an expanse that corresponds to the expanse of the chamber to be served by the fourth throttle 31.

Figure 2:
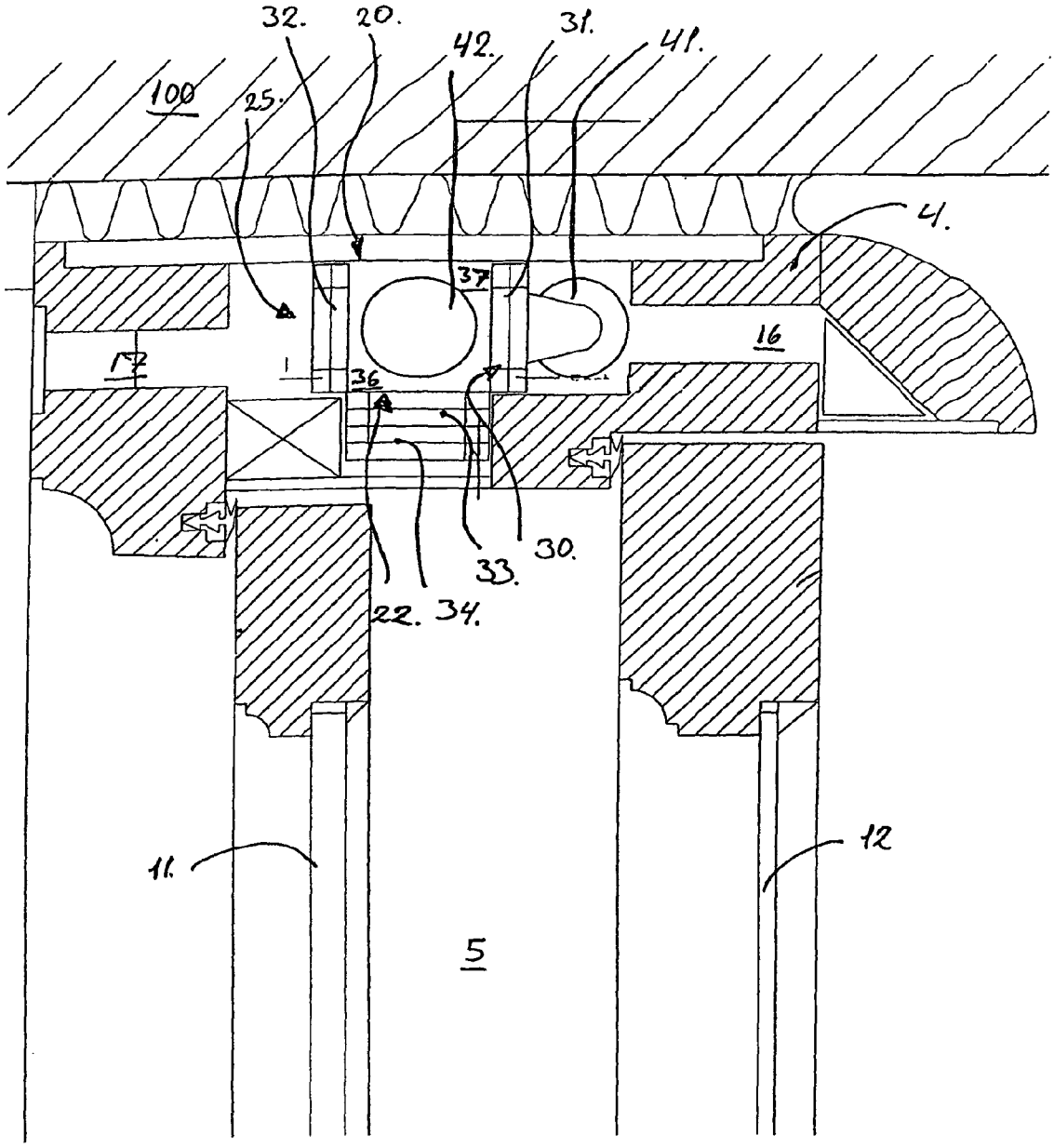

FIG. 2 is a sectional view of a window frame at the upper frame element 4, wherein a ventilation device 20 according to the invention is arranged. In connection with the bottom frame element 3, the double window 1 comprises a first flow passage (15 in FIG. 1) which is in communication with the open. In the upper frame element 4, the window 1 comprises a second flow passage 17 and a third flow passage 16, wherein said second flow passage 17 communicates with a room in a building which is delimited by a building wall 100 into which the double window 1 is incorporated. The third flow passage 16 is configured to communicate with the open. Between the first glass pane (interior glass pane) 11 and second glass pane (exterior glass pane) 12 of the window, an air space 5 is formed that communicates with the open through said first flow passage 15 (in FIG. 3) and said third flow passage 16, and moreover communicates with the room of the building via the second flow passage 17.

It will be possible to move throttles 31, 32, 33, and 34 steplessly, as they will thus be completely open, completely closed or positioned in any position between those two extreme positions.

As will appear from FIG. 2, the ventilation device 20 is configured in the upper frame element in such a manner that the flows of air are able to pass through the ventilation device 20 exclusively via its passages 30. First throttle 33 and second throttle 34 are configured for being able to block the flow of air through third flow passage and second flow passage 16, 17 by variation of the opening area in passages 30. Throttles 33, 34 are configured for blocking the air space 5 from first chamber and second chamber 36, 37.

Thus, FIGS. 3*a-d* show a ventilation device 20, seen from four positions, FIG. 3*a* showing the ventilation device 20 seen from the rear side 24, ie the side that faces towards the room of the building when the ventilation device 20 is mounted in the upper frame element 4 (FIG. 2). FIG. 3*b* shows the ventilation device 20 seen from the bottom 22, ie from the side that faces downwards when the ventilation device 20 is mounted; and FIG. 3*c* shows the ventilation device 20 seen from the top side 21. FIG. 3*d* shows the front side 23 of the ventilation device, ie the side that faces outwards towards the open when the ventilation device 20 is mounted.

In the front side 23, rear side 24 and bottom 22 the ventilation device 20 is configured with a plurality of passages 30 arranged in a row essentially throughout the entire length of the ventilation device. Those passages 30 serve to cooperate with displaceable throttles (31, 32, 33, 34) that are displaceable in the longitudinal direction of the ventilation device 20, whereby the openings of passages 30 can be modified and hence the regulate the amount of air able to travel through passages 30.

Compared to the longitudinal direction of the ventilation device 20, an essentially airtight separating wall 26 is provided centrally in the ventilation device and between two adjoining passages 30, whereby first chamber and second chamber 36, 37 are formed to each their side of the wall 26. In the present embodiment, the wall 26 is configured centrally in the ventilation device 20, but in particular cases it may advantageously be configured with another size distribution between first chamber and second chamber 36, 37.

At the bottom of the ventilation device two displaceable plate throttles 33, 34 are arranged which are displaceable in the longitudinal direction of the ventilation device 20 and configured for cooperating with passages 30 at the bottom. Where the third throttle 32 may be a plate of a length that corresponds essentially to the full length of the device, the other throttle 24 can be a plate of half the length of the third throttle 32. Advantageously the plate throttles will comprise apertures corresponding to passages 30. By displacement of the bottom throttles the opening degree of the passages 30 is modified, and the amount of air able to pass through the passages 30 is regulated. The fourth throttle 31 is configured for cooperating with the passages 30 in the second chamber 37, where the third throttle 32 is configured for cooperating with passages 30 in both first chamber and second chamber 36, 37.

Operation of throttles 31, 32, 33, and 34 is advantageously performed by means of a first and a second self-operating thermohydraulic actuator 41, 42, which contain a liquid with a temperature-expansion coefficient determining the traveling of the throttles. The first self-operating thermohydraulic actuator 41 for operating the first throttle 33 of the front side 23 is arranged on the outside of the front side, the first self-operating thermohydraulic actuator 41 being in that position arranged within the air flow from a third flow passage 16, and hence it will be able to react swiftly to temperature changes in the air flow. Besides, in accordance with the invention it is an option to use motorized actuators for operating the throttles.

It will be understood that in case of decreasing temperatures actuation of the throttles occur in opposite sequence.

Below a preferred embodiment of the invention will be described. The embodiment has the following advantages:

Heat recovery from the air space for exploitation of, on the one hand the solar heat, on the other, the unavoidable heat loss from the interior glass pane to the air space during periods when there is a need for heating of the room located there behind.

Ventilation of the air space during periods when there is no need for heating the room located there behind (in the summer) with a view to cooling the interior glass/the entire window construction (including the sealing of double glazing, if any, which does not tolerate elevated temperatures).

Direct ventilation of the space from the open in case of high outdoor temperatures, where the lowest possible temperature of the ventilation/fresh air is achieved when it is taken directly from the open (and not from the air space, where, most often, a considerably higher temperature than the outdoor one will prevail). In the ventilation window complete sealing prevails between both the exterior and the interior frames and sill. The air intake between the frames is a slot in the bottom frame wherein an insect and dust filter is mounted. Thereby an ascending flow of air (thermology) from the bottom of the window to the automatic three-way valve in the upper frame is ensured. The throttle will be incorporated in the top frame in such a manner as to ensure that it is arranged sealingly in the milled slot and that "false" air does not occur.

The air space is ventilated so as to avoid condensation.

Considerable advantages in respect of energy and comfort are accomplished on the one hand by recovering the heat loss that will unavoidably occur from the internal extra glass pane to the air space, on the one hand by rendering the solar heat/incidence of sun useful which will, under the influence of the sun through the window, occur in the air space.

Ventilation

1. Normal Scenario

Intake of fresh air without inconveniences caused by draught. Recovery of heat and utilization of solar heat.

Fresh air is taken in through the filter at the bottom frame and here it is heated by the heat from the room and the solar heat from the outside; it rises due to thermology; and flows as preheated fresh air into the room through the valve in the top frame element.

2. Minimum Scenario

Cold weather with minimum heat contribution to space between glass panes.

The fresh air will feel cool and give rise to problems caused by draught. Weak ventilation is maintained so as to ensure that condensation problems do not occur between the glass panes. Cold air flows inwards through the filter at the bottom frame element, upwards between the glass panes, and a predetermined minimum amount of air is conveyed into the room through the throttle in the upper frame element.

3. Cooling

Warm weather, outside heating season. The system is turned around to serve as cooling system.

The hot air provides maximum flowthrough between the glass panes, but is conveyed back into the open. Hereby the interior glass pane is cooled.

Hot air from the outside flows through the filter at the bottom frame element, upwards between the glass panes and back to the open through the valve in the upper frame element. Fresh air is taken in without preheating through the open valve at the upper frame element.

Three-Way Valve

Incorporation of a three-way valve in the upper frame element consisting of four air throttles to be actuated by two self-operating thermohydraulic actuators accomplishes automatic control and regulation of an ascending flow of air between the two window frames, preheated by heat recovery from the inside and solar heat from the outside.

Normal Scenario, 2A-2B

During the heating season when the outdoor temperature is below the desired room temperature of eg 21° C. and it is also possible to accomplish a temperature in the air space in excess of eg 12° C., the amount of replacement air is controlled and regulated via the valve by means of a throttle regulation towards the air space. The valve is mounted in the top frame and the ventilation air is conveyed from an intake for fresh air in the lower frame element through the air slot between the external and internal glass pane via an automatic (slide) throttle in the top frame element and further into the room.

Minimal Scenario, 1

During the heating season when the outdoor temperature is below the desired room temperature of eg 21° C. and it is not possible to accomplish a temperature in the air space of eg 12° C. or above, the slide throttle is in its minimum position.

In this operating scenario, the exchange of air in the room may very well be reduced from eg 0.5 to eg 0.25.

The set value for the temperature in the air space (which may in accordance with the above be eg 12° C.) is determined based on whichever may now be found to be optimal in view of the desire to avoid draught and minimize energy consumption. On the other hand, it is also desired to supply a suitable amount of replacement air to the room of the building/the flat.

Cooling Scenario, 3

Outside the heating season, when the outdoor temperature is slightly above the desired room temperature, eg 21-23° C., a slide throttle is automatically opened in the top frame element towards the open, thereby providing direct passage of air from the space to the open and from the air space to both the open and the room. In case of an outdoor temperature of about 23° C. the slide throttle will be fully opened towards the open.

Outside the heating season when the outdoor temperature has risen to 23° C. or above, a secondary "half" (slide) throttle is closed fully in relation to the separating wall that divides the ventilation device longitudinally between the room and the air space.

Simultaneously with/connected thereto a "half" throttle is closed on the other side of the separating wall towards the air space.

When the temperature has risen to about 27° C., both of these "half" throttles are fully closed, and, thus, in that operating scenario direct communication is established between the room and the open (throughout half of the length of the throttle), and there is also communication between the air space and the open (throughout the other half of the length of the throttle).

Hereby the desired functions have been achieved that ensure, on the one hand, cooling of the air space between the exterior and the interior glass pane and, on the other, that the room is ventilated directly towards the open.

On extremely hot summer days it is presupposed that the requisite supplementary room ventilation is provided by opening of the windows.

A more simple variety may be that the above throttle regulations were manual or partially manual and not to be operated automatically.

The invention claimed is:

1. A ventilation device for ventilation of a building having an interior and an exterior comprising:

a double-window, said double window comprising at least two window glass panes and an air space, wherein said air space is between said window glass panes;

a first throttle;

a second throttle;

a third throttle;

a fourth throttle;

a first actuator is configured for actuating the first throttle, and a second actuator is configured for actuating the second throttle, the third throttle and the fourth throttle;

a first chamber wherein said first chamber is in communication with the building interior and exterior; and a second chamber, wherein said second chamber is in communication with the building interior and exterior;

wherein said first throttle selectively controls passage of air from said air space into said first chamber, wherein said second throttle selectively controls passage of air from said air space into said second chamber; wherein said third throttle selectively controls passage of air from said first chamber into said building interior; and wherein said fourth throttle selectively controls passage of air between said building exterior and said first and second chamber, wherein temperature-sensitive actuators automatically control each of said first throttle, second throttle, third throttle, and fourth throttle and wherein dependent upon the temperature, 1/air from said air space will flow into the building interior or 2/air from said air space will flow to the building exterior.

2. The device of claim 1, said double window comprising a bottom frame element and an upper frame element, wherein said air space communicates with said building exterior via a first flow passage in said bottom frame element, and a third flow passage in said upper frame element; and wherein said air space communicates with said building interior via a second flow passage in said upper frame element.

3. A device according to claim 1, wherein the actuators are self-operating thermohydraulic actuators containing a liquid having a temperature expansion coefficient, wherein expansion of said liquid controls movement of at least one of said first throttle, said second throttle, said third throttle, or said fourth throttle.

4. A device according to claim 1, wherein at least one actuator is located in the first chamber.

5. A device according to claim 1, wherein the device is configured as an elongate box-shaped unit for being incorporated in the upper frame element or upper frame of the double window.

6. A method of ventilating a room in a building by use of a ventilation device having at least two temperature dependent modes, the method comprising:

in a first temperature dependent mode, allowing air within an air space from beneath a first chamber and a second chamber in the ventilation device to flow into an interior of the building through the first and the second chambers via a first throttle and a second throttle; and in a second temperature dependent mode, allowing air from the air space to flow through the first chamber to an exterior of the building by closure of the second throttle and a third throttle, and opening of a fourth throttle, simultaneously with air from the building exterior being allowed to flow into the interior of the building through the second chamber via the fourth throttle, wherein at least one actuator is configured for traveling and by which the throttles are actuated, and wherein, during a first direction of traveling, the actuator closes the fourth throttle, and, during a second direction of traveling, it closes the second and the third throttles and opens the fourth throttle.

7. A method according to claim 6, having a third temperature dependent mode wherein by partial opening of the fourth throttle air within said air space is allowed to flow between the air space and into the building interior via the first and the second chambers, simultaneously with air being allowed to flow from the exterior and into the building interior via the first and the second chambers.

8. A method according to claim 6, wherein the actuators are self-operating thermohydraulic actuators containing a liquid having a temperature expansion coefficient that determines the traveling of the throttles.

* * * * *